United States Patent [19]

Duder et al.

[11] Patent Number: 4,535,810

[45] Date of Patent: Aug. 20, 1985

[54] ELECTRICALLY CONTROLLED VALVES

[75] Inventors: Richard A. Duder, Campbell; Allan B. Corral, San Jose, both of Calif.

[73] Assignee: Dynamic Valves, Inc., Palo Alto, Calif.

[21] Appl. No.: 593,944

[22] Filed: Mar. 27, 1984

[51] Int. Cl.[3] ..... F15B 13/044

[52] U.S. Cl. ..... 137/596.17; 137/625.44; 137/625.65; 137/870

[58] Field of Search ..... 137/596.17, 625.44, 137/625.65, 870, 875

[56] References Cited

U.S. PATENT DOCUMENTS

| | | |
|---|---|---|
| 2,928,409 | 3/1960 | Johnson et al. . |
| 3,063,422 | 11/1962 | Gregowski et al. . |
| 3,455,330 | 7/1969 | Williams et al. . |
| 3,833,017 | 9/1974 | Gordon et al. . |

FOREIGN PATENT DOCUMENTS

| | | | |
|---|---|---|---|
| 853200 | 8/1981 | U.S.S.R. | 137/625.65 |

OTHER PUBLICATIONS

"Piezoceramic Bender Elements", Gulton Industries, Inc.

*Primary Examiner*—Gerald A. Michalsky
*Attorney, Agent, or Firm*—Edward D. O'Brian; K. H. Boswell

[57] ABSTRACT

An electrically controlled valve using a piezoelectric strip as an actuator can be constructed so as to include a valve body having separate pressure and return chambers connected by two different load passages. These load passages are connected to service ports used to connect a load to the valve. These passages are open at their ends into the two chambers. A pressure port is used to supply a fluid under pressure to the pressure chamber while a return port is used to convey fluid from the return chamber. The actuator is mounted in such a manner that it can be actuated by an electric signal to move with respect to the openings in the chambers so as to cause an increase in the pressure in one of the load passages and a decrease in the pressure in the other. The position of the actuator can be reversed. When the valve is not in use the actuator is located so that the pressures in both of the load passages are the same.

9 Claims, 10 Drawing Figures

12
10
18
20
16
60
68
72
52
78
80
82
77
70
84
14

ELECTRICALLY CONTROLLED VALVES

BACKGROUND OF THE INVENTION

The invention set forth in this specification pertains to new and improved electrically controlled valves. The valves of this invention are presently intended for use with pneumatic fluids. It is considered, however, that these valves can either directly be employed with hydraulic fluids or can be easily modified so as to be suitable for use with hydraulic fluids in various different applications.

A wide variety of different electrically controlled valves are, of course, known. They are used in many different environments for many different purposes. Fortunately an understanding of the present invention does not require an understanding of the vast majority of such prior structures. It is considered, however, that an understanding of this invention is best predicated upon an understanding of two different types of prior electrically controlled valves.

Valves of the first of these types are constructed so as to utilize a torque motor in order to control the position of am armature so as to in turn either directly or indirectly control the flow from a source of fluid under pressure to a load so as to accomplish useful work. In general, these prior valves employing a torque motor are constructed so that the torque motor is in effect a separate and distinct element from the actual valve structure with which it is used. In effect, the torque motor in a valve of this type is coupled to the valve structure through the armature.

Such an armature is normally a comparatively rigid structure which is movably mounted on the valve structure at the location or locations where it passes more or less from the torque motor into the interior of the valve structure by an appropriate flexible or deformable member such as a bellows-like diaphragm or a comparative thin walled deflection tube. This type of deformable member is used to isolate the torque motor for the interior of the valve structure. Within the valve structure in this type of valve the armature can be utilized in different ways. It is conventional to use the armature so that an end of it is disposed between two opposed nozzles in such a manner that the position of the armature relative to the nozzles determines the amount of flow from the nozzles.

It is also known to form the armature in this type of valve so it has ends or bifurcations extending into two different separate chambers which are connected to one another by what may be referred to as load passages. Each of the load passages used in this type of structure is connected to an opening or nozzle in each of the separate chambers. With this type of structure when the armature is moved so as to control the flow between it and the two nozzles in one of the chambers it is concurrently moved so as to control the flow in the other of the chambers. The so-called "load" on a valve of this type is connected generally between or across the two load passages as, for example, by connecting one end of a cylinder serving as a load to one of the passages and the other end of such a cylinder to the other of the passages.

While this particular type of torque motor actuated valve employing such a bifurcated armature is considered to be effective and utilitarian it is also considered to be comparatively undesirable because of the close tolerances necessary to make a desirable valve of this type because of the relative slowness of the response time of the valve to an electric signal resulting from the inherent characteristics of the torque motor—armature type structure involved. This latter particularly involves the inertia of the armature used. Further, this type of valve is comparatively undesirable from an economic standpoint because of the costs involved in manufacturing a valve of this type. In this connection it is noted that while a torque motor is not prohibitively expensive to manufacture that such a motor is still a separate element which, on a comparative basis, is somewhat undesirably expensive to construct.

Valves of the second type which are important to an understanding of this invention are those valves which are constructed so as to utilize a piezoelectric strip as an actuator so as to control flow from opposed orifices. Known valves of this type utilize a piezoelectric strip cantilevered so that it's unsupported end is located in a chamber between two opposed orifices corresponding to the opposed nozzles commonly utilized in connection with the armature on the torque motor.

With structures of this type the relative position of the strip with respect to the two different orifices can be used so as to control flow from both of these nozzles so as to in turn change the pressures in passages connected to different parts of a load used to perform different useful work. Valves of this type are different from those torque motor valves described in the preceding discussion in which the bifurcations or spaced ends of an armature extend into two different chambers in several ways. They employ only a single chamber. The position of the piezoelectric strip in such a valve alone is responsible for any variable pressure change in this type of valve. In addition, of course, there are other obvious differences.

Piezoelectric valves as described in the preceding are considered to be disadvantageous for different reasons than the torque motor operated valves previously discussed. It is considered that these known piezoelectric valves can not provide an adequate pressure differential between the two different orifices to perform many different types of tasks normally associated with different types of loads such as cylinders as indicated in the preceding discussion. This is considered to be extremely significant.

Further, these prior valves have apparently been constructed so as to utilize relatively small orifices. This is considered rather surprising since other related valves utilizing piezoelectric strips have been constructed so that such a strip is used in controlling the flow from a single comparatively large opening or port to the interior of a chamber from which the emitted fluid passes through one or more openings or ports which are spaced significantly from the piezoelectric strip. In any event, the utilization of such small orifices obtaining a significant pressure drop is disadvantageous in that such an orifice can only pass or convey a limited amount of fluid and inasmuch as such an orifice can become clogged rather easily.

This particular matter of an orifice or nozzle becoming clogged is of comparative importance in connection with any pneumatic or hydraulic servo valve. When an orifice or similar opening in any such a valve becomes clogged with one or more contaminant particles there is a significant danger of the valve either not performing in an intended manner and/or one or more parts of the valve breaking. This can be particularly significant in valves such as the torque motor type valves indicated in the preceding discussion where, the spacing between nozzles and an end of an armature is comparatively restricted in nature even at the comparatively extreme position of the armature. This is because of the possibility of a particle becoming lodged generally between the nozzle and the armature. This is a different type of blocking or clogging action than is caused by a particle merely plugging up a comparatively restricted orifice. Clogging of this type has the potential of interfering with the operation of the torque motor used.

As a result of this clogging problem it has normally been considered necessary to utilize both of the types of valves indicated in the preceding discussion with comparatively expensive filters capable of removing comparatively small particles of contaminants and concurrently causing a significant pressure drop between the ends of the filter. The latter is, of course, undesirable in these instances where it is desirable to maintain as much of a pressure differential as possible across a load so as to accomplish a significant amount of useful work.

BRIEF SUMMARY OF THE INVENTION

As a result of various considerations such as are indicated in the preceding discussion it is considered that there is a distinct need for new and improved electrically controlled valves. The present invention is to fulfill this comparatively broad, generic-type need. More specifically it is intended to provide electrically controlled valves which are capable of being utilized instead of prior torque motor valves as in various applications where such torque motor valves were not satisfactory or desirable. The invention is further intended to provide valves of a type hereinafter described which are particularly desirable in that they provide what may be referred to as an adequate pressure gain or pressure differential which is material enough so that a load controlled by such a valve can perform a significant amount of useful work.

The invention is also intended to provide valves as described in which there is an adequate volume of fluid flow which, in general, is normally greater than that in prior related valves of a comparable size as indicated in the prior discussion so that these valves are, by reason of the volume of flow, capable of doing significant useful work per volume of fluid passing through the valve. In addition, the invention is intended to provide electrically controlled valves which are desirable because of their comparatively short or "good" response time.

From a consideration of valves in this invention as subsequently discussed it will also be realized that the invention is intended to provide valves which may be easily and neatly constructed at a comparatively nominal cost, which are of such a character that they are capable of rendering prolonged, reliable service even with fluids containing quantities of contaminants which would be significant in effecting the performance of other related valves over prolonged periods.

In accordance with this invention these various objectives are achieved by providing a valve, said valve having a body formed so as to include separate pressure and return chambers, separate first and second load passages, each of said passages extending between and terminating in an opening in each of said chambers, a pressure port leading into said pressure chamber, a return port leading from said return chamber, first and second load ports connected to said first and second load passages, respectively, actuator means extending into said chambers for controlling the flow of fluid from said pressure port through said openings in said pressure chamber into each of said load passages for controlling the flow of fluid from said openings in said return chamber from said load passages to said return port in which the improvement comprises: said actuator means comprising a member mounted on said body so as to extend into each of said chambers in such a manner that said chambers are isolated from one another, said member being capable of being electrically actuated so that the portion of it within said pressure chamber and the portion of it within said return chamber are concurrently moved relative to said openings in said chambers upon the application of an electric signal so as to permit increased flow to either one of said passages from said pressure chamber and concurrently to restrict the flow from such passage into said return chamber while concurrently restricting the flow into the other of said flow passages from said pressure chamber and increasing the flow from such other passages into said return chamber.

BRIEF DESCRIPTION OF THE DRAWINGS

Because of the nature of this invention it is best more fully explained with reference to the accompanying drawings in which.

Figure 1:
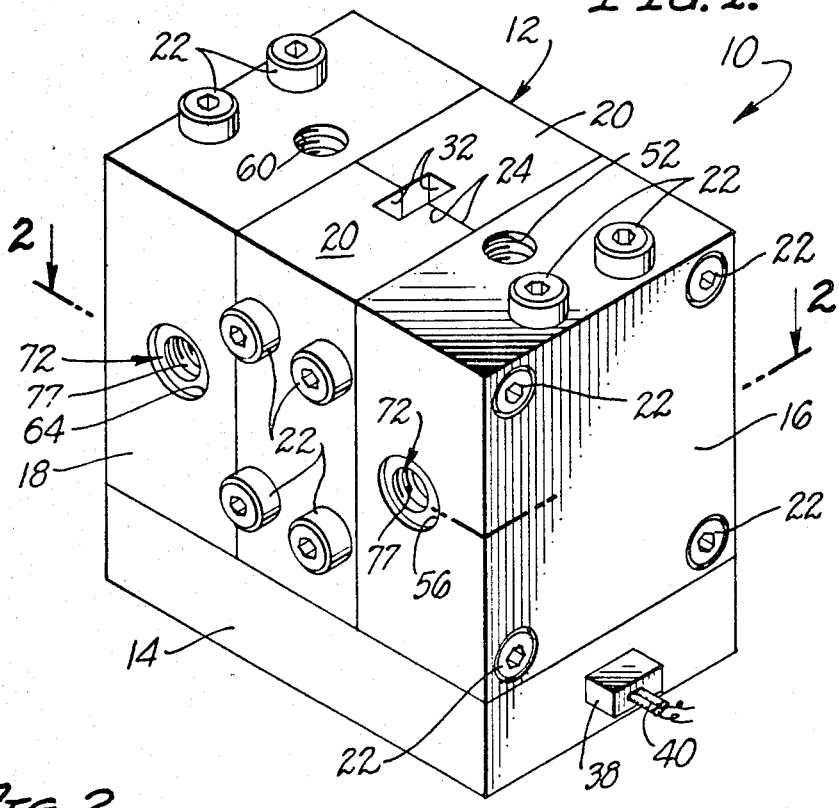
FIG. 1 is an isometric view of a presently preferred embodiment or form of an electrically controlled valve in accordance with this invention.

The precise valve shown in the drawings is constructed so as to utilize the operative principles or concepts of the present invention defined and set forth in the appended claims forming a part of this specification. These concepts or principles can be utilized in a number of somewhat differently appearing, somewhat differently constructed valves through the use or exercise or routine engineering skill in the field of electrically operated valves by a person possessing such skill who has had an opportunity of understanding the principles or concepts of this invention. Because of this the accompanying drawings are not to be taken as limiting the scope of this invention in any respect.

DETAILED DESCRIPTION OF THE PREFERRED EMBODIMENT

The electrically controlled valve shown in the drawing is designated by the numeral 10. It includes a valve body 12 which consists of a base plate 14, first and second end members 16 and 18 and two holding blocks 20. The holding blocks 20 will normally be formed of a rigid, electrically nonconducting material such as an appropriate grade of nylon, teflon or the like. The plate 14 and the members 16 and 18 are conveniently formed of a metal such as aluminum or steel, but they can also be formed out of a rigid polymer material if, for any reason, this is desired. The various parts of the body 12 are preferably secured to one another in the manner illustrated in the drawings through the use of conventional fasteners 22. Inasmuch as the manner in which the fasteners 22 serve their intended function is essentially self-obvious it is not described in detail in this specification.

Figure 2:
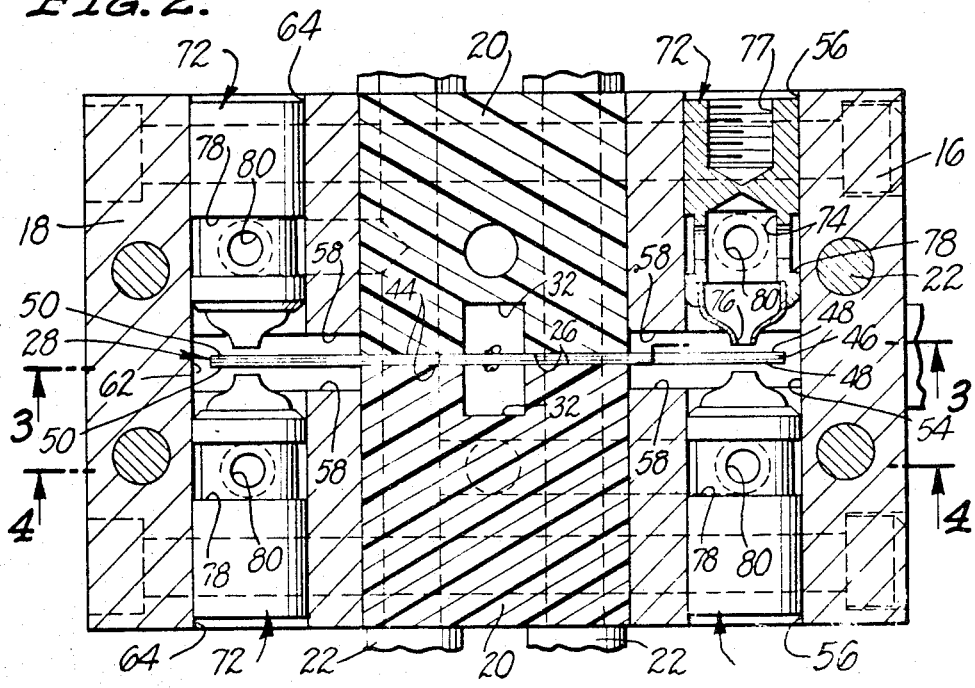
FIG. 2 is a cross-sectional view at an enlarged scale taken at line 2—2 of FIG. 1.
Figure 3:
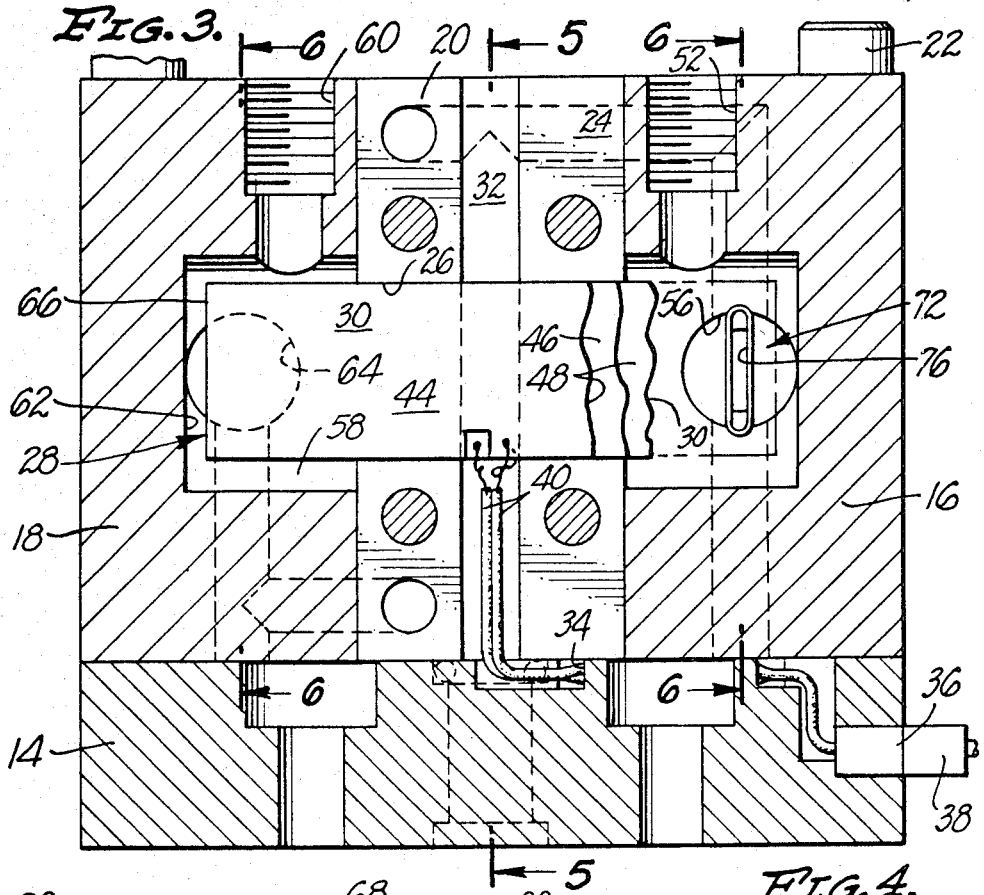
FIG. 3 is a cross-sectional view taken at line 3—3 of FIG. 2.
Figure 4:
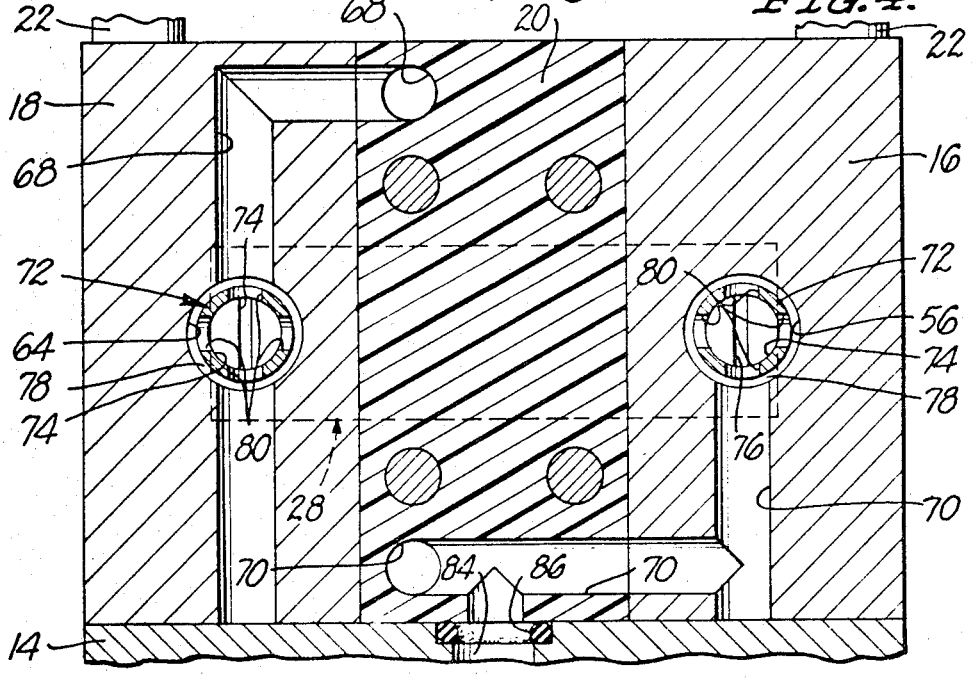
FIG. 4 is a cross-sectional view taken at line 4—4 of FIG. 2.
Figure 5:
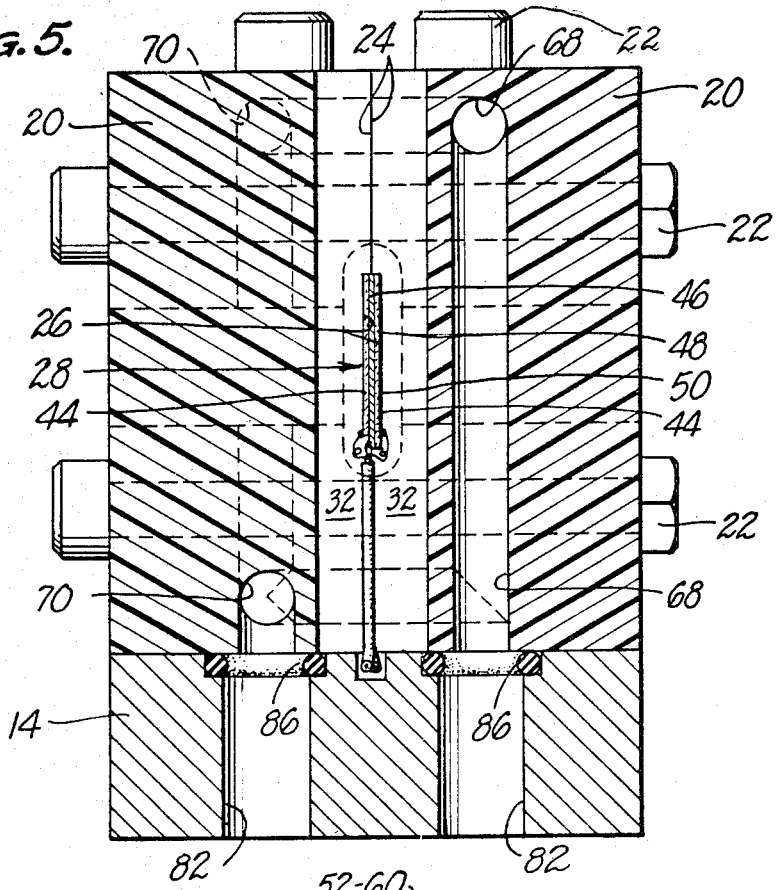
FIG. 5 is a cross-sectional view taken at line 5—5 of FIG. 3.
Figure 6:
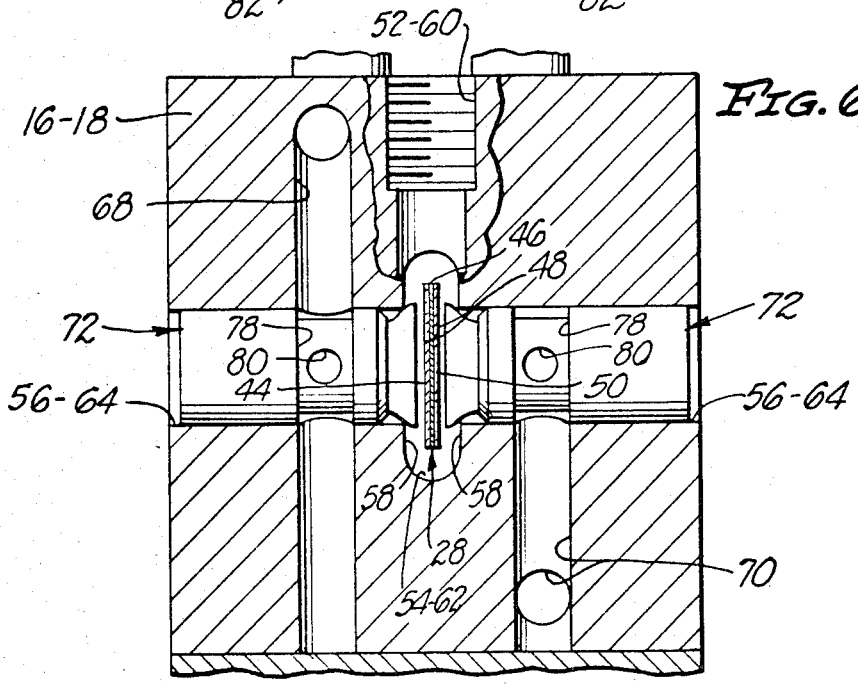
FIG. 6 is a partial cross-sectional view taken at line 6—6 of FIG. 3.

The holding blocks 20 are clamped together by four of the fasteners 22 so that these blocks 20 are held with surfaces 24 on them in direct contact to a sufficient extent so that there is no reasonable possibility of any fluid flowing generally between these two blocks. Flat grooves 26 are formed in the surfaces 24 for the purpose of holding an elongated piezoelectric strip or actuator 28 in the manner shown in FIGS. 2, 3 and 5 of the drawings. This actuator 28 is, in effect, clamped between the blocks 20 so that equally sized ends 30 of it extend from the blocks 20 as shown in FIGS. 2 and 3. It is held in such a manner that there is no possibility of fluid passing within the grooves 26 generally along or around the actuator 28.

The surfaces 24 are provided with opposed grooves 32 which extend generally along the actuator 28 within the surfaces 24. These grooves 32 are in communication with a passage 34 in the base plate 14 which leads to a small conventional connector socket 36. This socket is adapted to be used in connection with a conventional electrical plug 38 for the purpose of connecting the plug 38 with wires 40 extending through the passage 34 and through the grooves 32 to adjacent to the actuator 28. There these wires 42 are connected to opposed surfaces 44.

The nature of this actuator 28 is quite important in connection with this invention. The preferred actuator 28 for use with this invention is a piezoceramic bender element including a centrally located, elongated metal strip 46 secured to two layers 48 of a piezoelectric ceramic material. A very thin electrode 50 is applied to each of the layers 48. With the structure shown the actuator 28 is in the nature of a sandwich consisting of the metal strip 46 bonded between the two layers 48. If desired an appropriate conventional adhesive (not shown) may be used in securing the layer 48 to the strip 46. The electrodes 50 used are normally quite thin and do not interfere with any bending of the complete actuator 28. One of the wires 40 in the structure shown is preferably connected to the strip 46 in a conventional manner while the other of the wires 40 is connected to each of the electrodes 50. The metal strip 46 is preferably of a type conventionally used in reinforcing a piezoelectric bender element which either is of a material conventionally used as a spring or which has spring like characteristics. It is presently considered that it will be best to form this actuator 48 so that the strip is of a beryllium copper alloy. It is considered obvious that other reasonably related materials may be used.

The two end members 16 and 18 are of nearly an identical construction. The end member 16 may be referred to as a pressure end member 16 because it contains a pressure port 52 leading into an enlarged internal pressure chamber 54. Holes 56 lead to opposed sides 58 of this chamber 54. The end member 18 may be referred to as a return end member 18 inasmuch as it contains a return port 60 leading from a return chamber 62 corresponding to the pressure chamber 54. Holes 64 corresponding to the holes 56 extend between the sides 66 of this return chamber 62.

Figure 10:
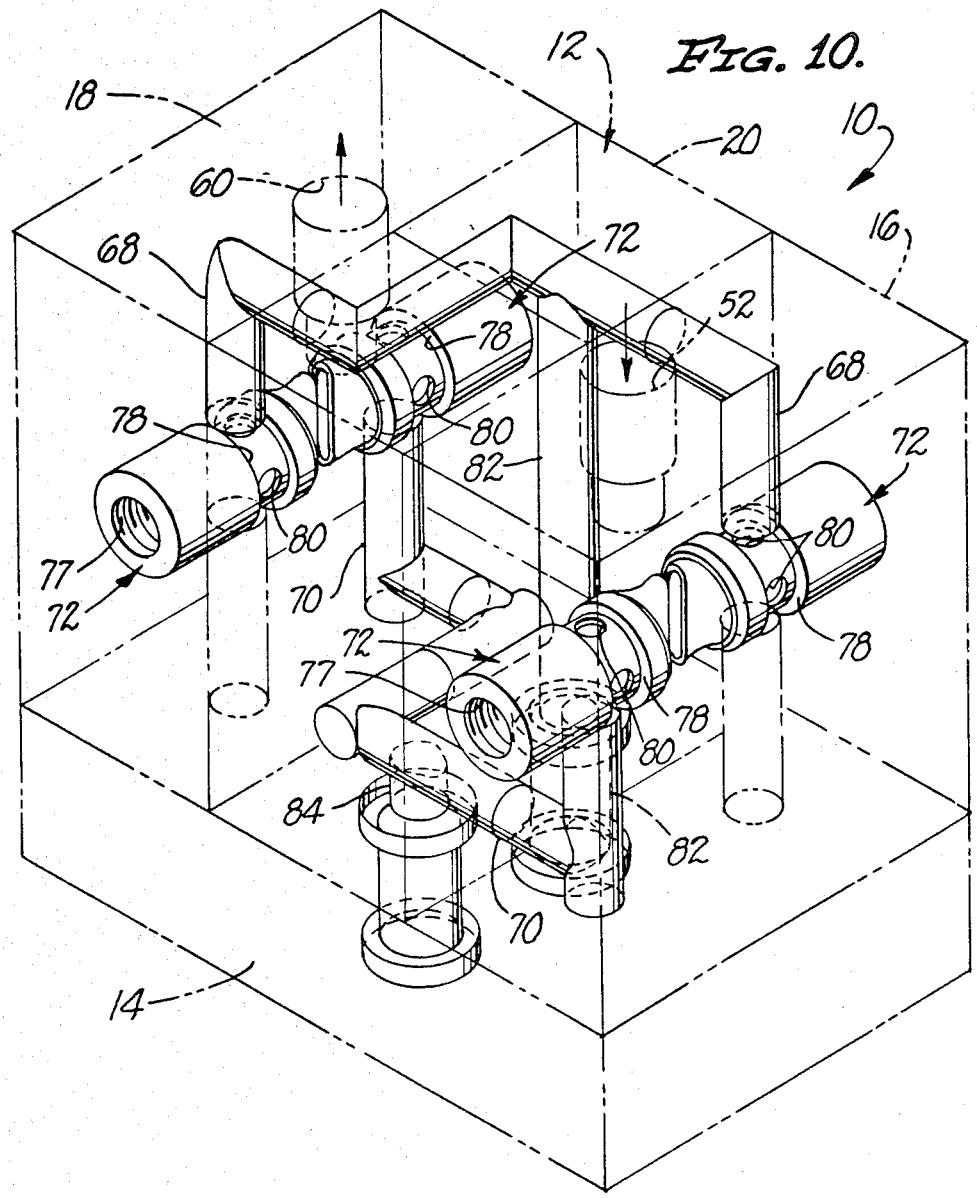
FIG. 10 is an isometric view in which various passages and nozzles shown in FIGS. 1-6 are shown as tangible elements and in which the parts of the valve containing these various elements are shown in phantom.

One of the holes 56 is connected to one of the holes 64 through the use of what may be referred to as a first load passage 68. The other of the holes 56 is connected to the other of the holes 64 through the use of what may be referred to as a second load passage 70. These two load passages 68 and 70 extend not only through the end members 16 and 18, but in addition, extend through the holding blocks 20. In effect, they could be regarded as a series of separate passages joined to one another in the manner in which piping is assembled. The manner in which these individual passages 68 and 70 extend is shown in FIG. 10. In this figure they are shown in solid lines, whereas the blocks 20 and the members 16 and 18 are shown in this figure by phantom lines.

In order to achieve the preferred manner of operation each of the holes 56 and 64 is provided with a nozzle 72. All of the nozzles 72 are of identical construction. Each of them includes an internal passage 74 leading to an elongated vertically extending somewhat slot-like nozzle opening 76. These passages 74 are connected to peripheral grooves 78 in the nozzles 72 through the use of small openings 80. When the nozzles 72 are in place these grooves 78 are in direct communication with either the passage 68 or the passage 70.

The nature of the nozzle openings 76 employed in connection with the nozzles 72 is considered important in obtaining a preferred valve in accordance with this invention. In each nozzle 72 the opening 76 should be of an elongated rectilinear or oval shape which maximizes the perimeter length around the nozzle per unit of cross sectional area of the nozzle opening. This type of known structure maximizes the flow between the nozzle 72 and the ends 30 of the actuator 28. This is advantageous in maximizing the useful work obtainable from the fluid used with the valve 10.

Figure 7:
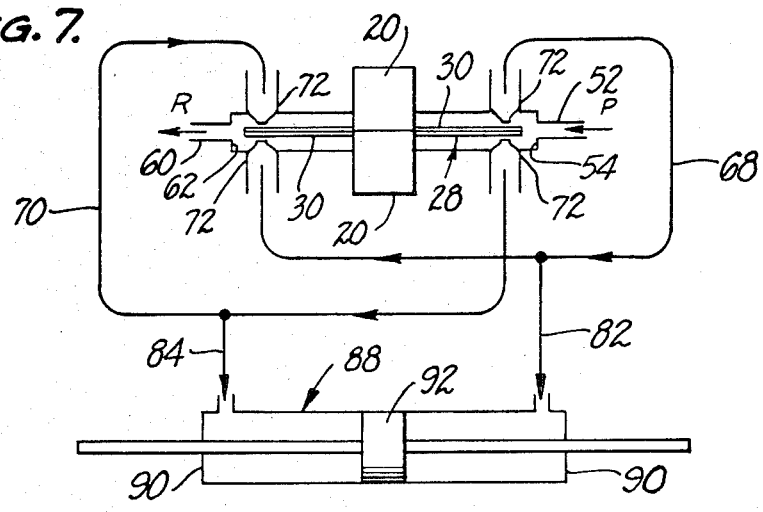
FIGS. 7, 8 and 9 are diagrammatic views intended to explain the operation of the valve shown in the preceding Figs. in controlling the operation of a cylinder serving as a load.

These nozzles 72 may, of course, be positioned in place in a number of different ways. Preferably they are press fitted within the holes 56 and 64 so that the nozzle opening 76 are equally spaced from the ends 30 when the actuator 28 extends linearly as shown in the initial six figures of the drawing and as shown in FIG. 7. The openings 76 are oriented relative to these ends 30 so as to extend substantially parallel to the holding blocks 20 while the actuator 28 is oriented so as to extend substantially perpendicularly to these blocks 20. This is considered important with respect to the present invention. Threaded holes 77 may be provided in the nozzles 72 for use in removing them for servicing.

The physical structure of the valve 10 is completed by the addition of first and second load ports 82 and 84 respectively in the base plate 14 which lead to the first and second load passages 68 and 70 respectively. If desired conventional seals 86 may be placed around these ports 82 and 84 between the base plate 14 and the holding blocks 20.

Figure 8:
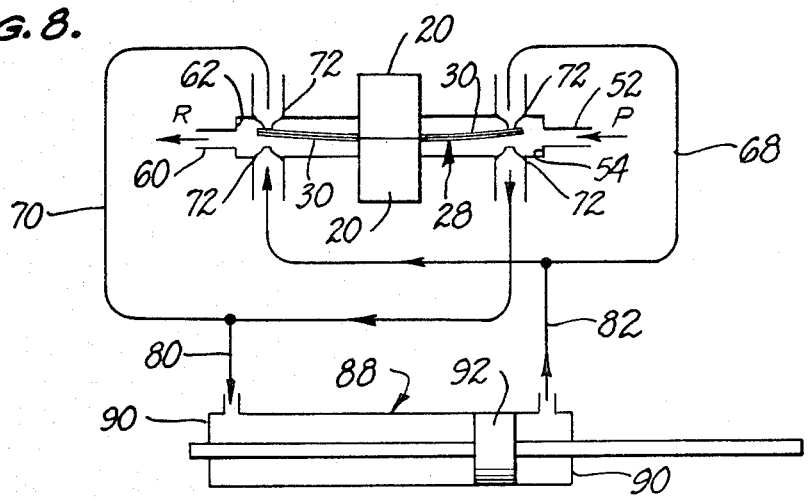
Figure 9:
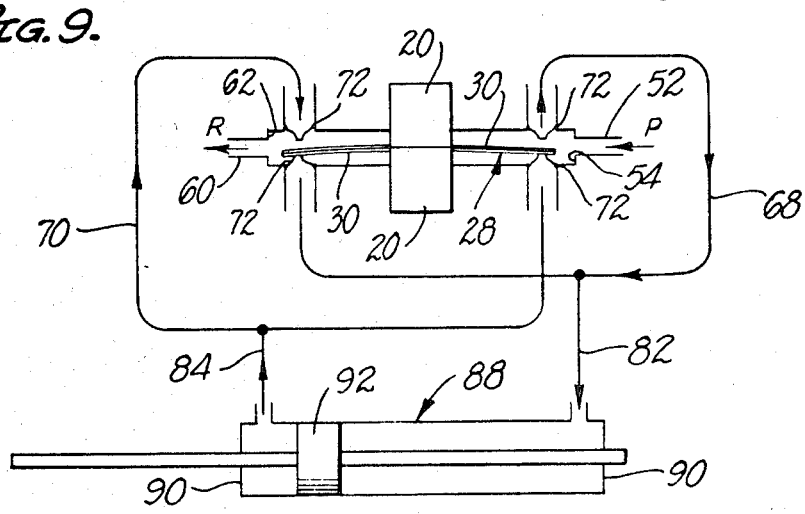

When the valve 10 is to be used the pressure port 52 is, of course, connected to a source of fluid (not shown)—preferably, but not necessarily a pneumatic fluid—under pressure while the load ports 82 and 84 are connected to a load 88 such as a hydraulic cylinder diagramatically illustrated in FIGS. 7, 8 and 9. These ports 82 and 84 are, of course, connected to opposed ends 90 of the cylinder 88 so as to be separated by a piston 92 within the cylinder 88. In addition the return port 60 is either connected to a conventional return line (not shown) or is vented to the ambient.

At this time the valve 10 is in a ready to use position or configuration. When it is in this "configuration" because of the ends 30 of the actuator 28 being located midway between the nozzles 72 and because of the nozzle openings 76 being oriented in a corresponding manner, the flow from the pressure port 52 through the pressure chamber 54 will result in equal pressures being conveyed to the passages 68 and 70. Concurrently because the end 30 of the actuator 28 within the return chamber 62 is located relative to the nozzle 72 leading into this chamber in a similar manner the pressures within the two passages 68 and 70 will be held so as to be the same. As a result no useful work will be performed by the load 88.

When, however, an electronic signal is applied to the actuator 28 through the wires 40 in a conventional or different manner the actuator 28 will be caused to be bent or bowed in either the manner shown in FIG. 8 or the manner shown in FIG. 9 of the drawings. Only the ends 30 of this actuator 28 will bow in the manner shown because of the holding action of the holding blocks 20. The manner in which the ends 30 are bowed can, of course, be changed at will by changing the direction of the current applied to this actuator 28.

When the actuator 28 is bowed as indicated in FIG. 8 flow from the pressure port 52 to the first load passage 68 will be blocked while concurrently flow from this first load passage 68 to the return port 60 will be expedited as a result of the configuration of the actuator 28. Concurrently, flow from the pressure port 52 into the second passage 70 will be expedited as a result of the movement of the actuator 28 while flow from this second passage 70 to the return port 60 will be blocked as a result of the movement of the actuator 28. These various "actions", of course, create a pressure differential which will create pressure differentials which will be transmitted to the load 88 through the ports 82 and 84. This will cause the piston 92 to move from a position as shown in FIG. 7 to a position as shown in FIG. 8.

At this point the actuator 28 may be caused to assume its initial position by an appropriate signal being passed to it. The spring-like character of the strip 46 is considered important in causing the actuator 28 to resume such an initial position as shown in FIG. 7. When the actuator 28 has been moved in this manner the forces within the passages 68 and 70 will become rapidly equalized and as a consequence no fluid will be supplied to be used in performing work by the load 88. At this point of time or immediately after the actuator 28 has been caused to assume a position as indicated in FIG. 8, the signal supplied by the wires 40 may be changed in accordance with conventional practice or otherwise so as to bow the actuator 28 as shown in FIG. 9. This will result in a pressure build up within the first load passage 68 and a lessening of the pressure within the second load passage 70 which will cause the piston 92 to move in the opposite direction from the direction it moved previously.

It is considered that it will be obvious that it will be possible to modify the valve 10 in quite a number of manners within the scope of routine skill or ability. It is considered possible to provide a useful valve corresponding to the valve 10 in which the individual nozzles 72 are omitted and in which the holes 56 and 64 are used as these nozzles 72. The use of nozzles 72 as discussed, is however, considered to be highly advantageous in increasing the volume of flow within a valve to do useful work to as great an extent as reasonably possible. This is important from a practical standpoint.

It is also important that the pressure port 52 be located relative to the actuator 28 as shown or in such other manner that the flow from this port 52 will not affect the position or movement of the actuator 28 by impinging on it.

It is also important from a practical standpoint that the pressure gain achievable with a valve such as the valve 10 will normally be large enough for the normal needs of a pneumatic or hydraulic system. In effect a comparatively large pressure gain to do useful work is achieved with a valve such as the valve 10. It is also considered quite important that the response time of a valve such as a valve 10 is quite low. This is considered to be related to the inherent characteristics of the actuator 28 used. Such an actuator is not a comparatively large or bulky member such as an armature used in a conventional valve employing or incorporating a torque motor. As a result of this the inertia of the actuator 28 is, on a comparative basis, quite low when compared to a conventional torque motor armature.

The inherent resiliency of the complete actuator 28 resulting from the use of the metal strip 46 is considered to be quite important from a practical standpoint. Valves such as this valve 10 are capable of "accomodating" comparatively large contaminants such as would normally be expected to interfere with the operation of other prior valves of a similar, related character. It is considered that this is in part related to the fact that the actuator 28 can temporarily deform to at least a degree so as to minimize the chances of a nozzle such as the nozzle 72 becoming clogged. As a consequence of the valve 10 being able to handle somewhat contaminated—albeit not horribly contaminated—fluids, it is not considered necessary to filter a fluid passed to the valve 10 to the degree that a fluid is normally filtered in connected with similar valves.

We claim:

1. A valve, said valve having a body formed so as to include separate pressure and return chambers, separate first and second load passages, each of said passages extending between and terminating in an opening in each of said chambers, a pressure port leading into said pressure chamber, a return port leading from said return chamber, first and second load ports connected to said first and second load passages, respectively, actuator means extending into said chambers for controlling the flow of fluid from said pressure port through said openings in said pressure chamber into each of said load passages for controlling the flow of fluid from said openings in said return chamber from said load passages to said return port in which the improvement comprises:

said actuator means comprising a member mounted on said body so as to extend into each of said chambers in such a manner that said chambers are isolated from one another, said member being capable of being electrically actuated so that the portion of it within said pressure chamber and the portion of it within said return chamber are concurrently moved relative to said openings in said chambers upon the application of an electric signal so as to permit increased flow to either one of said passages from said pressure chamber and concurrently to restrict the flow from such passage into said return chamber while concurrently restricting the flow into the other of said flow passages from said pressure chamber and increasing the flow from such other passages into said return chamber, said member is an elongated member held at its center by said body so that equal amounts of said member located at the ends of said member extend into each of said chambers, said actuator means is a piezoelectric bender strip mounted on said body so that one end of said strip extends into one of said chambers and the other end of said strip extends into the other of said chambers, said body engaging said strip so as to isolate said chambers from one another.

2. A valve as claimed in claim 1 wherein:

equal amounts of said strip are located within each of said chambers.

3. A valve as claimed in claim 1 wherein:

said strip includes a centrally located flat, elongated metal electrode and support element, flat sheet-like piezoelectric ceramic bender elements attached to and supported by said electrode and support element, and electrodes covering said bender elements.

4. A valve as claimed in claim 1 wherein:

said strip includes a centrally located flat, elongated metal electrode and support element, flat sheet-like piezoelectric ceramic bender elements attached to and supported by said electrode and support element, and electrodes covering said bender elements, said electrode and support element has the properties of a spring.

5. A valve as claimed in claim 4 wherein:

equal amounts of said strip are located within each of said chambers.

6. A valve as claimed in claim 5 wherein:

said pressure port is located so that flow from said pressure port into said pressure chamber will not affect the position of that portion of said strip within said pressure chamber.

7. A valve as claimed in claim 4 wherein:

said openings are non-round nozzle openings and are located adjacent to said strip so as to maximize said fluid flow between said openings and said strip.

8. A valve as claimed in claim 1 wherein:

said strip includes a centrally located flat, elongated metal electrode and support element, flat sheet-like piezoelectric ceramic bender elements attached to and supported by said electrode and support element, and electrodes covering said bender elements, said electrode and support element has the properties of a spring, equal amounts of said strip are located within each of said chambers, said pressure port is located so that flow from said pressure port into said pressure chamber will not affect the position of that portion of said strip within said pressure chamber, said openings are non-round nozzle openings and are located adjacent to said strip so as to maximize said fluid flow between said openings and said strip.

9. A valve as claimed in claim 1 wherein:

said pressure port is located so that flow from it into said pressure chamber will not affect the position of that portion of said member within said pressure chamber.

* * * * *